US005465863A

United States Patent [19]

Seick et al.

[11] Patent Number: 5,465,863

[45] Date of Patent: Nov. 14, 1995

[54] RECYCLABLE STEEL DRUM FOR HOT FLOW PRODUCTS

[75] Inventors: Thomas Seick, Hoffman Estates, Ill.; Rex E. Wagers, Kingsport, Tenn.

[73] Assignee: Greif Bros. Corporation, Delaware, Ohio

[21] Appl. No.: 29,184

[22] Filed: Mar. 10, 1993

[51] Int. Cl.[6] ..... B65D 25/16

[52] U.S. Cl. ..... 220/403; 220/453; 220/404

[58] Field of Search ..... 220/453, 404, 220/403, 461, 460, 466

[56] References Cited

U.S. PATENT DOCUMENTS

| | | | |
|---|---|---|---|
| 1,591,373 | 7/1926 | Griffiths . | |
| 1,944,042 | 1/1934 | Thompson . | |
| 1,969,120 | 8/1934 | Coakley . | |
| 2,082,760 | 6/1937 | Berni . | |
| 2,721,674 | 10/1955 | Lazard . | |
| 2,752,074 | 6/1956 | Martin . | |
| 2,861,714 | 11/1958 | Glossop . | |
| 3,220,602 | 11/1965 | Ficker | 220/453 |
| 3,357,626 | 12/1967 | Carpenter et al. . | |
| 3,377,766 | 4/1968 | Nelson . | |
| 3,412,903 | 11/1968 | Van Riper, Jr. et al. . | |
| 3,443,735 | 5/1969 | Meijers . | |
| 3,545,643 | 12/1970 | Higgins et al. . | |
| 3,629,092 | 12/1971 | George | 220/453 |
| 3,648,881 | 3/1972 | Rogers | 220/453 |
| 3,946,871 | 3/1976 | Sturm | 220/453 |
| 4,347,948 | 9/1982 | Hamada . | |
| 4,526,290 | 7/1985 | Cerny | 220/453 |
| 4,595,119 | 6/1986 | Cho | 220/453 |
| 4,658,989 | 4/1987 | Bonerb . | |
| 4,666,041 | 5/1987 | Gordon . | |
| 4,702,390 | 10/1987 | Rinkovsky, Sr. | 220/453 |
| 4,949,872 | 8/1990 | Heaps, Jr. . | |
| 5,098,751 | 3/1992 | Tamura et al. | 220/453 |
| 5,137,206 | 8/1992 | Hale . | |
| 5,232,117 | 8/1993 | Hale . | |

FOREIGN PATENT DOCUMENTS

| | | |
|---|---|---|
| 902597 | 7/1954 | Germany . |
| 2814414 | 10/1979 | Germany . |
| 457520 | 11/1934 | United Kingdom . |
| 726687 | 3/1955 | United Kingdom . |

*Primary Examiner*—Joseph Man-Fu Moy
*Attorney, Agent, or Firm*—Kane, Dalsimer, Sullivan, Kurucz, Levy, Eisele and Richard

[57] ABSTRACT

A metal drum and the method of making the same having a detachable lining removable therefrom after a first use to allow for the reuse or recycling of the drum.

17 Claims, 4 Drawing Sheets

RECYCLABLE STEEL DRUM FOR HOT FLOW PRODUCTS

The subject matter of this application is related to the subject matter commonly assigned of U.S. application Ser. No. 07/867,821 filed on Apr. 13, 1992, now U.S. Pat. No. 5,232,117 and U.S. application Ser. No. 08/041,393 filed on Mar. 31, 1993, now U.S. Pat. No. 5,320,243.

BACKGROUND OF THE INVENTION

1. Field of Invention

This invention relates to a drum used for transporting goods, and more particularly to a steel drum with a removable liner for containing material including liquid or semi-liquid materials which is reusable and/or recyclable.

2. Description of Prior Art

Cylindrical containers such as steel drums have been used for a long time as a means of storing or transporting a variety of materials including powdery or granular solids, or liquids and semi-liquids. These containers are built to withstand the exigencies of transit. The materials stored in them are removed by first removing the top of the containers and then pouring or pumping the materials out.

Drums are sometimes used to store so-called semi-liquid materials such as adhesives, lubricants, hazardous material or other material that would contaminate or leave contaminants on the interior surface thereof. This may involve materials which are basically meltable plastics which may be poured therein. These materials solidify upon cooling. To remove the material one uses a machine with a plunger, which is heated and equipped with an "O" ring type of seal. After removing the top cover, and disc seal, the drum is ready for emptying the contents. As the plunger is pushed downwardly into the drum, the heater melts and liquifies the materials and as the plunger moves downwardly, the material is pumped out through the plunger and put into the manufacturing process.

When the plunger gets toward the bottom of the drum, there remains a small amount of material which cannot be pumped out but is left in the bottom of the container after the plunger heating system has been removed. Such drums are normally used once and then discarded since the interior has become contaminated with the material it contained. Disposal and even recycling of such drums because of this is difficult. It has become desirable to provide drums however that may be reused or subject to recycling.

Moreover, steel drums are typically made of a heavy gauge metal and are relatively expensive. In view of the shipped material contaminating the interior surface of the drum, reuse is not possible, recycling is difficult and disposal may require special handling.

OBJECTIVE AND SUMMARY OF THE INVENTION

It is therefore an object of the invention to provide for a steel drum which is reusable and/or constructed such that it facilitates recycling.

A further objective is to provide a reusable drum adapted to hold and dispense semi-liquids such as hot melts which require special removal equipment.

Other objectives and advantages of the invention shall become apparent in the description of the invention.

The above objectives are attained by a metal drum having a sidewall steel shell open at both ends, a curl portion at each end. The drum is formed with a removable special liner. The liner comprises a fibre stock release-coated sheet which is adhesively positioned around the inside surface of the drum. Rings are placed on the top and bottom to hold covers in place. The drum can now be used to contain a wide variety of material. If after use the end user wishes to reuse the drum for a different product the top and bottom covers are removed. It is now possible to lift out the liner which may be disposed of and the liner replaced and rings added. The covers which may be similarly lined with a removable portion which is stripped therefrom and replaced with the covers reattached. The drum could now be used to contain other material. The liner on the drum sidewall has an upper edge disposed in a circumferential groove formed below the drum top to insure that the liner remains intact while the drum is emptied.

BRIEF DESCRIPTION OF THE DRAWINGS

Thus by the present invention, its objects and advantages will be realized, the description of which should be taken in conjunction with the drawings wherein.

DETAILED DESCRIPTION OF THE PREFERRED EMBODIMENT

Turning now more particularly to the drawings, there is shown a drum 10 which comprises a cylindrical shell 12 made out of metal such as heavy gauge steel. The drum 10 includes two detachable covers 14 and 16 which are affixed to the shell 12 by way of locking rings 18, 20.

Figure 1:
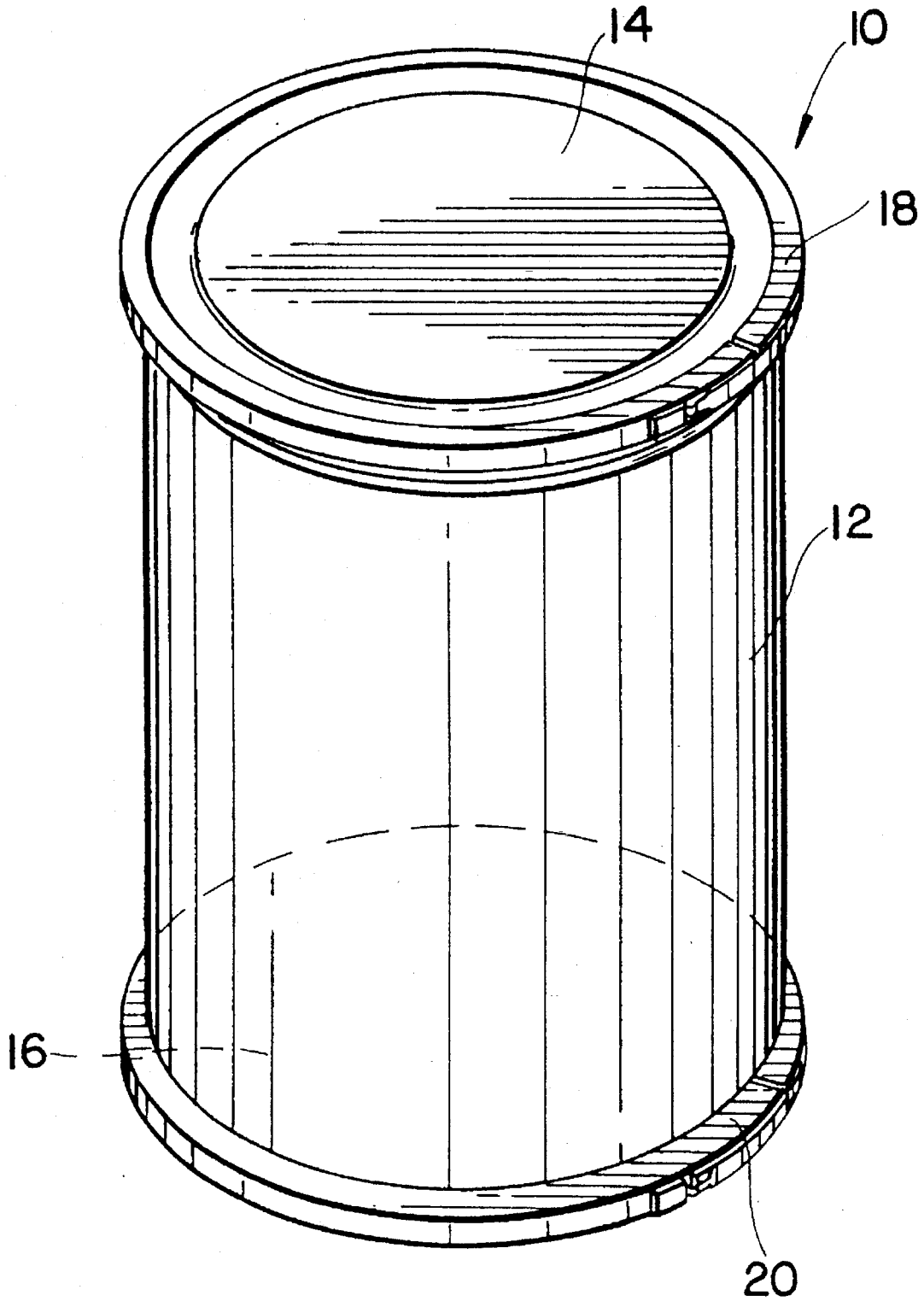
FIG. 1 is a perspective view of a reusable drum incorporating the teachings of the present invention.
Figure 2:
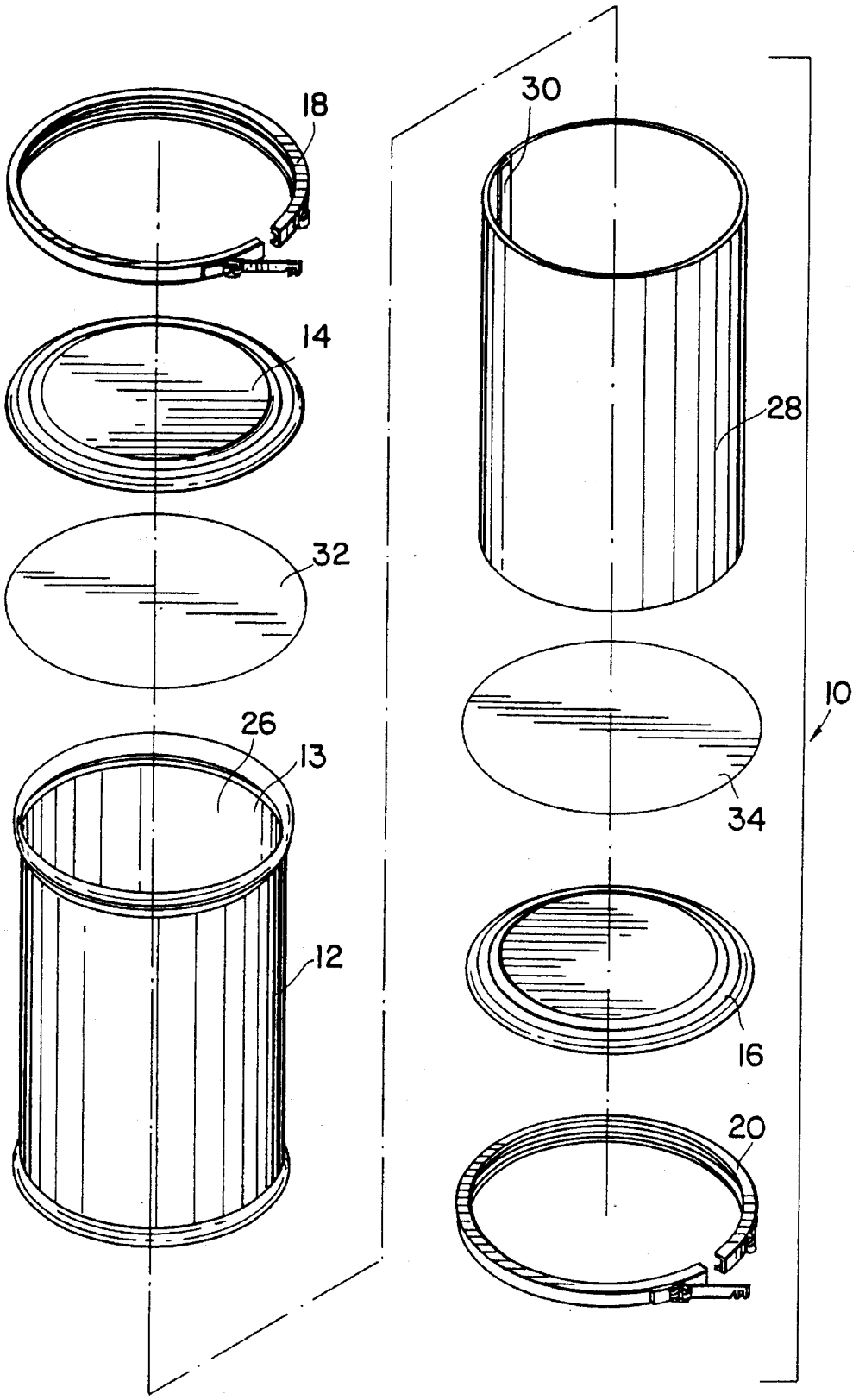
FIG. 2 shows an exploded view of the reusable drum of FIG. 1.
Figure 3:
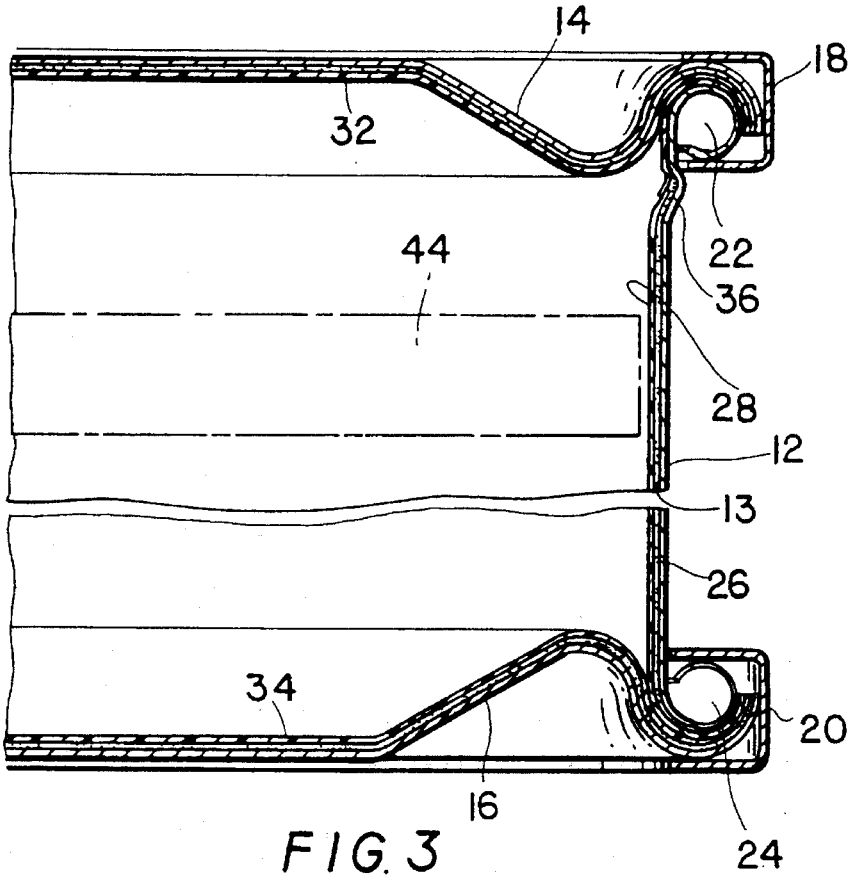
FIG. 3 shows an enlarged elevational sectional view of the drum.
Figure 4:
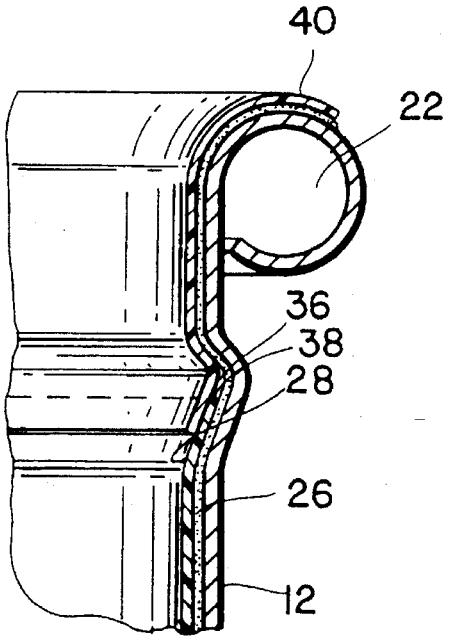
FIG. 4 shows a sectional view of the upper portion of the reusable drum of FIGS. 1–3.
Figure 5:
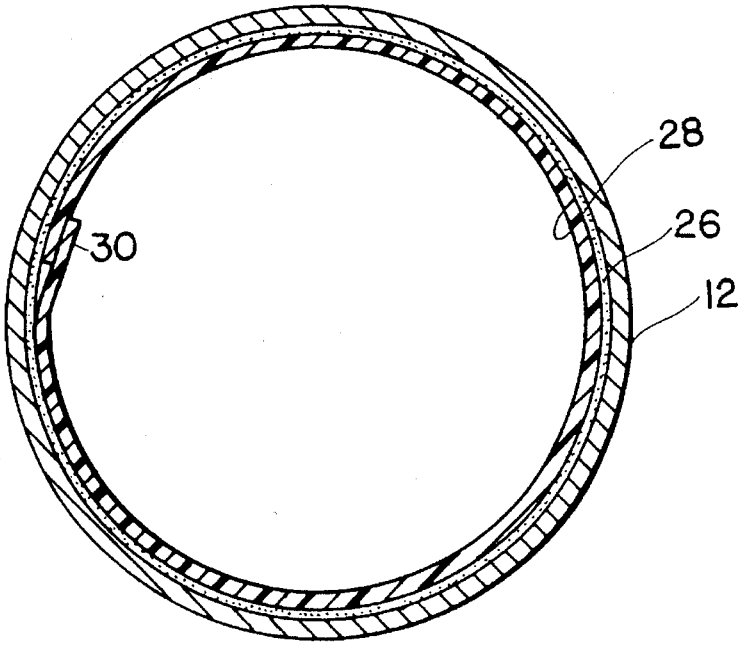
FIG. 5 shows a plan sectional view of the drum.
Figure 6:
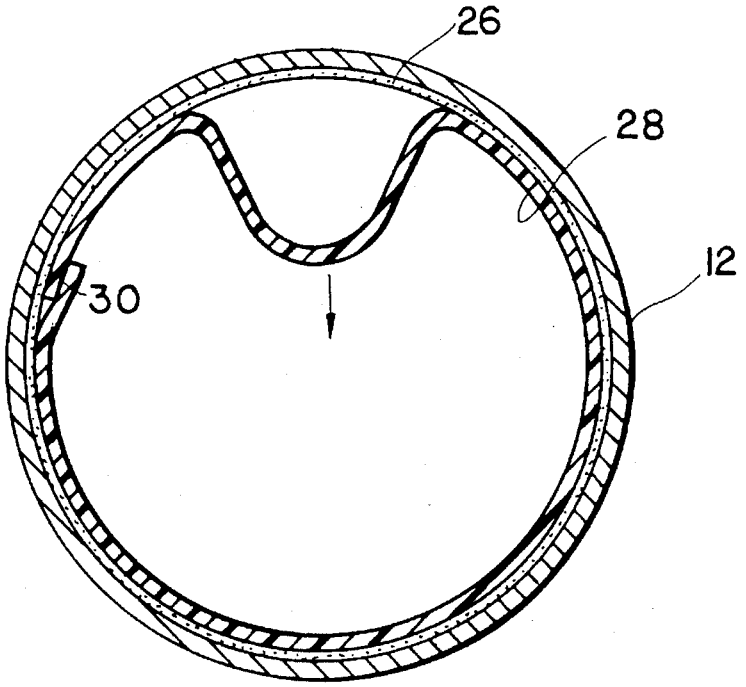
FIG. 6 shows a sectional view of the drum with the liner being removed.

The drum 10 illustrated may be used to contain a liquid or semi-liquid material which is extracted therefrom by way of a plunger device such as that illustrated in U.S. Pat. No. 3,412,903 to Van Riper Jr. The top and bottom of shell 12 terminate in a rolled edge or curl 22, 24 to which the respective covers are affixed as will be discussed. The inner surface 13 of the shell 12 is covered with layer 26 of pressure-sensitive adhesive about 3 mil thick. The covers 14 and 16 are similarly provided with an adhesive layer and a liner 32, 34 respectively. Disposed on the coated internal surface of shell 12 is a liner 28. Liners 28, 32, 34 may be made of release coated fibre such as silicone coated Kraft paper. The liner 28 should be impermeable to the material to be contained by the drum 10. The circumferential ends of the liner 28 are overlapped as at 30 (FIG. 5). The shell 12 is also provided with a circumferential groove 36 extending radially outwardly of inner surface 13. The top liner edge 38 of liner 28 is disposed in groove 36. A tape 40 is then placed circumferentially around curl 22 and extending downwardly into groove 36 to overlap and cover edge 38 as shown in FIG. 4.

Once the shell 12 and covers have been lined, the bottom cover 16 is affixed to shell 12 by locking ring 20. The drum is then filled with a material and the top cover 14 may be removably attached to the top of the shell 12 by way of a locking ring 18. Thus with the foregoing arrangement the entire interior surface of drum 10 is prevented from contacting the contained material.

To remove the material stored in drum 10, for example a hot flow-type material, the top cover 14 is first removed and hot melt head of a plunger 44 is inserted (shows by phantom lines). The drum 10 has a standard inner diameter so that the dispensing head 44 can easily fit into the drum. Importantly, because the liner edge 38 is disposed in groove 36, it is protected from the head. At the same time, since with the outwardly extending groove 36, the inner diameter of the drum is constant the plunger 44 is free to move up and down through the drum to selectively dispense its contents. As the plunger 44 advances downwardly into the drum, it does not rip the liner 28. Further protection for the liner 28 is provided by the tape 40 which insures that the liner edge 38 remains in groove 36. In addition, tape 40 also maintains the top of the surface 13 and curl 22 above liner 28 free of the material under the drum. After the plunger 44 reaches the bottom, it is withdrawn. The bottom cover 16 is now removed to gain access to the residue in the drum.

Once the drum 10 is depleted of its material, to reuse the drum the following steps are taken. The top and bottom covers 14 and 16 are removed and the liners 32, 34 are discarded and replaced with fresh liners. The tape 40 and liner 28 is also removed and disposed of. The shell interior is now fresh and uncontaminated. A new liner can then be placed in the interior of the drum and secured by a new tape.

Obviously, numerous modifications may be made to the invention without departing from its scope as defined in the attached claims.

We claim:

1. A reusable drum comprising:

a metal cylindrical shell having an open top and bottom ends and an interior surface with an outwardly extending circumferential groove disposed adjacent to the top end;

a releasable liner disposed on said interior surface and having a top end, and extending axially from said groove to the bottom end, the liner top end being disposed in said groove, said liner being impervious to the passage of material being contained in the drum, whereby said groove is disposed adjacent the top end of said shell to receive said liner top end so that said liner does not interfere with a plunger as it moves within the drum to selectively dispense its contents;

top and bottom covers; and releasable means for securing said covers to said shell to close said open ends;

whereby after the contents of the drum has been emptied, the liner is removed and another liner is applied on said interior surface prior to reuse of the drum.

2. The drum in accordance with claim 1 further comprising an adhesive coating for securing said liner to said shell.

3. The drum in accordance with claim 2, wherein said liner is coated with a release material for releasing said liner from said shell.

4. The drum in accordance with claim 1, wherein said bottom and top covers are metal and have respective detachable cover liners.

5. The drum in accordance with claim 1, wherein the top end of said shell is terminated in a curl and said groove is disposed below said curl.

6. The drum in accordance with claim 1 wherein said means comprise locking rings.

7. A reusable drum comprising:

a cylindrical shell having two opposed ends and an inner surface of constant diameter except for a groove disposed at one of said ends extending radially outwardly of said inner surface;

a releasable liner adhesively attached to said inner surface and extending axially from said groove to the other end, the liner having an end disposed in said groove, whereby said groove is disposed adjacent the top end of said shell to receive said liner top end so that said liner does not interfere with a plunger as it moves within the drum to selectively dispense its contents;

covers for closing said ends; and means for attaching said covers to said drums;

whereby after the contents of the drum has been emptied, the liner is removed and another liner is applied on said inner surface prior to reuse of the drum.

8. The drum in accordance with claim 7 further comprising an adhesive coating for securing said liner to said shell.

9. The drum in accordance with claim 8, wherein said liner is coated with a release material for releasing said liner from said shell.

10. The drum in accordance with claim 7, wherein the drum and said bottom and top covers are metal and have respective detachable cover liners.

11. The drum in accordance with claim 7, wherein the one end of said shell is terminated in a curl and said groove is disposed below said curl.

12. The drum in accordance with claim 7 wherein said means comprise locking rings.

13. The drum in accordance with claim 1 wherein a tape extends over the top end of the liner in the groove to the top end of the shell.

14. The drum in accordance with claim 7, wherein a tape extends over the end of the liner in the groove to the one end of the shell.

15. The drum in accordance with claim 1 further comprising an adhesive coating for securing said liner to said shell, said liner is coated with a release material for releasing said liner from said shell, said bottom and top covers are metal and have respective detachable cover liners, the top end of said shell is terminated in a curl and said groove is disposed below said curl, said means comprising locking rings, a tape extending over the top end of the liner in the groove to the top end of the shell.

16. The drum in accordance with claim 7 further comprising an adhesive coating for securing said liner to said shell, said liner being coated with a release material for releasing said liner from said shell, said bottom and top metal covers having respective detachable cover liners, said side wall being terminated in a curl and said groove being disposed below said curl, wherein the top end of said sheet being terminated in a curl and said groove is disposed below said curl, said means comprising locking rings, a tape extends over the end of the liner in the groove to the one end of the shell.

17. A reusable drum comprising:

a metal cylindrical shell having open top and bottom ends and an interior surface with an outwardly extending circumferential groove disposed adjacent to the top end;

a releasable liner disposed on said interior surface and having a top end, and extending axially from said groove to the bottom end, the liner top end being disposed in said groove, said liner being impervious to the passage of material being contained in the drum, whereby said groove is disposed adjacent the top end of said shell to receive said liner top end so that said liner does not interfere with a plunger as it moves within the drum to selectively dispense its contents;

top and bottom covers, said bottom and top covers being metal and have respective detachable cover liners;

releasable means for securing said covers to said shell to close said open ends;

whereby after the contents of the drum has been emptied, the liners are removed and another liner is applied on said interior surface and said covers prior to reuse of the drum.

* * * * *